US006561755B1

(12) United States Patent
Lotz et al.

(10) Patent No.: US 6,561,755 B1
(45) Date of Patent: May 13, 2003

(54) TURBOMOLECULAR PUMP

(75) Inventors: Heinrich Lotz, Wetzlar (DE); Jörg Stanzel, Wetzlar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/718,147

(22) Filed: Nov. 21, 2000

(30) Foreign Application Priority Data

Nov. 22, 1999 (DE) ..... 199 56 015

(51) Int. Cl.[7] ..... F03B 5/00
(52) U.S. Cl. ..... 415/90; 415/214.1; 415/215.1
(58) Field of Search ..... 415/90, 143, 213.1, 415/214.1, 215.1; 417/423.4

(56) References Cited

U.S. PATENT DOCUMENTS 3,947,193 A 3/1976 Maurice ..... 415/143
4,579,508 A * 4/1986 Tsumaki et al. ..... 415/170 R
5,063,661 A * 11/1991 Lindsay ..... 29/888.02
5,104,288 A * 4/1992 Groenendaal, Jr. et al. ..... 415/209.3
5,722,819 A 3/1998 Broisin et al. ..... 417/423.4

FOREIGN PATENT DOCUMENTS

DE 2218615 10/1973

* cited by examiner

*Primary Examiner*—Edward K. Look
*Assistant Examiner*—Dwayne J. White
(74) *Attorney, Agent, or Firm*—Sidley Austin Brown & Wood, LLP

(57) ABSTRACT

A turbomolecular pump including a cylindrical housing, and rotor and stator discs arranged in the housing and cooperating with each other to produce a pumping effect, with the cylindrical housing being formed of at least two housing parts separated along a cylinder axis and each formed, together with respective separated sections of the stator discs, as a one-piece unit.

3 Claims, 2 Drawing Sheets

TURBOMOLECULAR PUMP

BACKGROUND OF THE INVENTION

1. Field of the Invention

The present invention relates to a turbomolecular pump including a housing and stator and rotor disc arranged in the housing.

2. Description of the Prior Act

Active pumping elements of a turbomolecular pump consist of rotor and stator discs provided with vanes and arranged alternatively one behind the other. The rotor and stator discs have each an inner carrier ring on an outer side of which a vane is provided. The vanes of the rotor discs, which rotate with a high speed, produce, together with the stator vanes, a pumping effect. Spacer rings are arranged between the rotor discs at their outer circumference, separating the rotor discs from each other by a distance that insures a contact-free rotation of the rotor discs. Stator discs, together with spacer rings, form a stator which is centered by the housing inner wall, with the stator discs and spacer rings being, e.g., pressed to each other axially with springs, whereby the stator discs and the spacer rings form a rigid connection.

This conventional design of a turbomolecular pump has many drawbacks, the major one being the necessity to produce a large number of separate parts. This result in high manufacturing costs and increased assembly time and adversely affects repair and maintenance works. The need to maintain narrow tolerances, which are necessary for the reliable operation of the turbomolecular pump, together with a large number of parts, results in extremely high expenses. Further, radial centering and axial fixation of the stator discs require additional adjustment which, likewise, contributes to increased manufacturing costs.

German Publication DE OS 22 18 615 discloses a turbomolecular pump formed of one stator and one rotor arranged in the pump housing, with the stator being formed of two cylindrical shells. The drawback of this pump consists in that the stator should be mounted in a separate housing with a cumbersome radial centering and axial adjustment. This is accompanied by increased manufacturing costs and increased assembly time and involves expensive maintenance works. Unavoidable gaps between the stator and the housing results in disturbing return flows. Further, insufficient removal of heat, which is produced during the pump operation, from the pump adversely affects the operation of the pump.

The German Publication DE 07 51 297 discloses a turbomolecular pump the stator of which is also formed of two parts. This pump does not have a housing. Therefore, the stator is directly submerged into a reservoir. If a housing is provided, the above-mentioned drawbacks result.

Accordingly, an object of the present invention is to provide a turbomolecular pump a number of components of which is substantially reduced in comparison with conventional turbomolecular pumps.

Another object of the present invention is to produce a turbomolecular pump that can be produced with substantially reduced manufacturing costs in a shorter time and maintenance of which is substantially simplified.

A further object of the present invention is to produce a turbomolecular pump with improved removal of heat generated during the pump operation.

A still further object of the present invention is to produce a turbomolecular pump in which the return or backward flow is substantially reduced.

SUMMARY OF THE INVENTION

These and other objects of the present invention, which will become apparent hereinafter, are achieved by forming the cylindrical housing of at least two housing parts separated along a cylinder axis, with each part being formed, together with respective separated sections of the stator discs, as a one-piece unit.

The present invention permits to substantially reduce the number of components of a turbomolecular pump. Spacer rings are eliminated. This simplifies manufacturing and reduces assembly time. Also, the maintenance works are simplified and reduced. Obtaining of necessary tolerances is substantially facilitated in view of a smaller number of pump components. The radial centering and axial fixing is obtained upon manufacturing of the housing parts and do not require any further adjustment.

Inner leakage, which was caused by gaps between numerous stator elements, is eliminated, whereby disturbing backflows in these regions are eliminated to a most possible extent. The removal of heat, which is generated during the pump operation, is substantially improved due to the compact design of the housing and to the elimination of transitional regions which in conventional pumps hinder arrangement of the heat conductors for heat removal. In addition, provision of cooling or heating elements in the region of stator elements permits to provide for an operational temperature regulation of the entire construction, in particular, of pump active parts in dependence on the operational condition of the pump.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
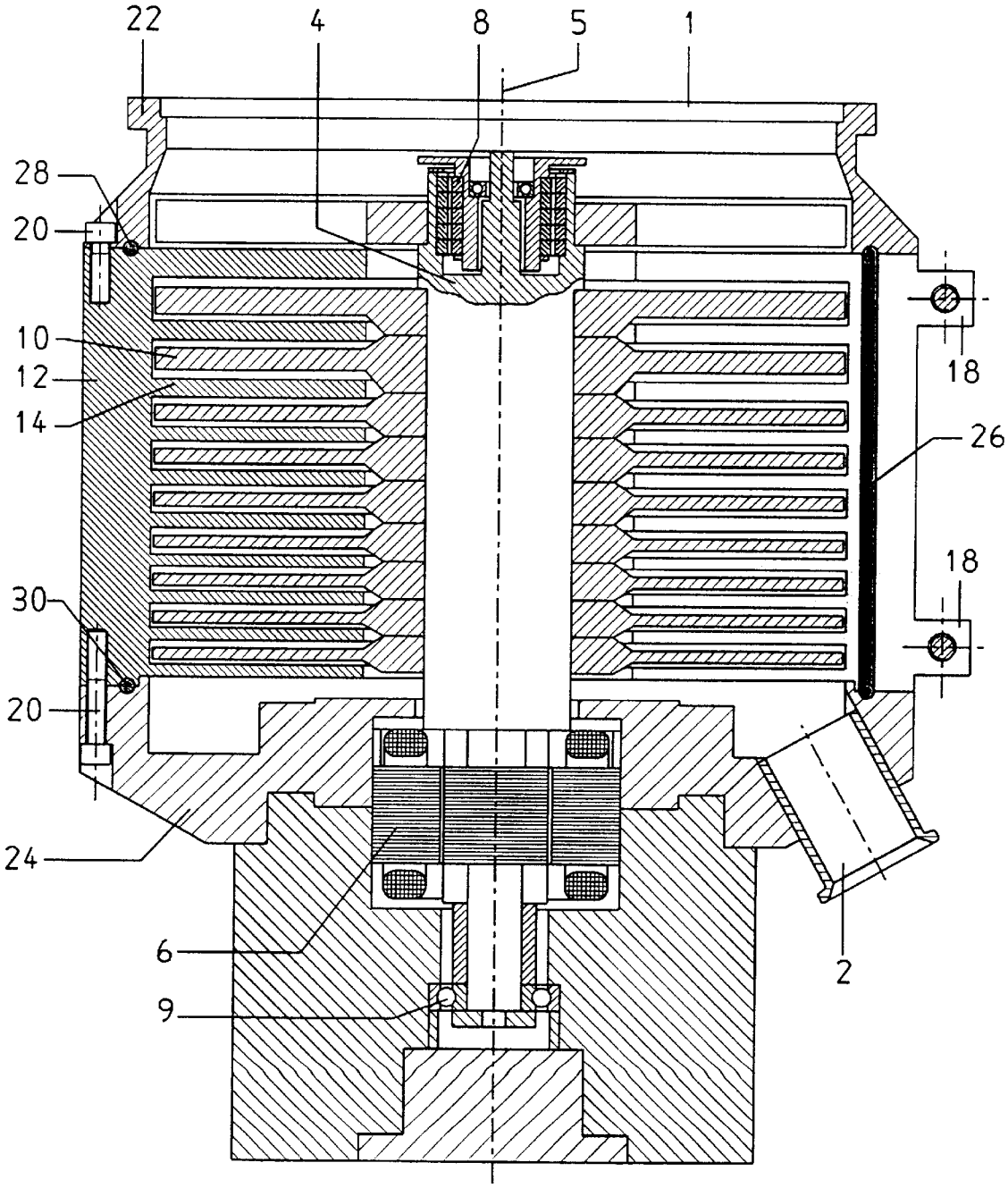
FIG. 1 a cross-sectional view along line A—A in FIG. 2 of a turbomolecular pump according to the present invention.
Figure 2:
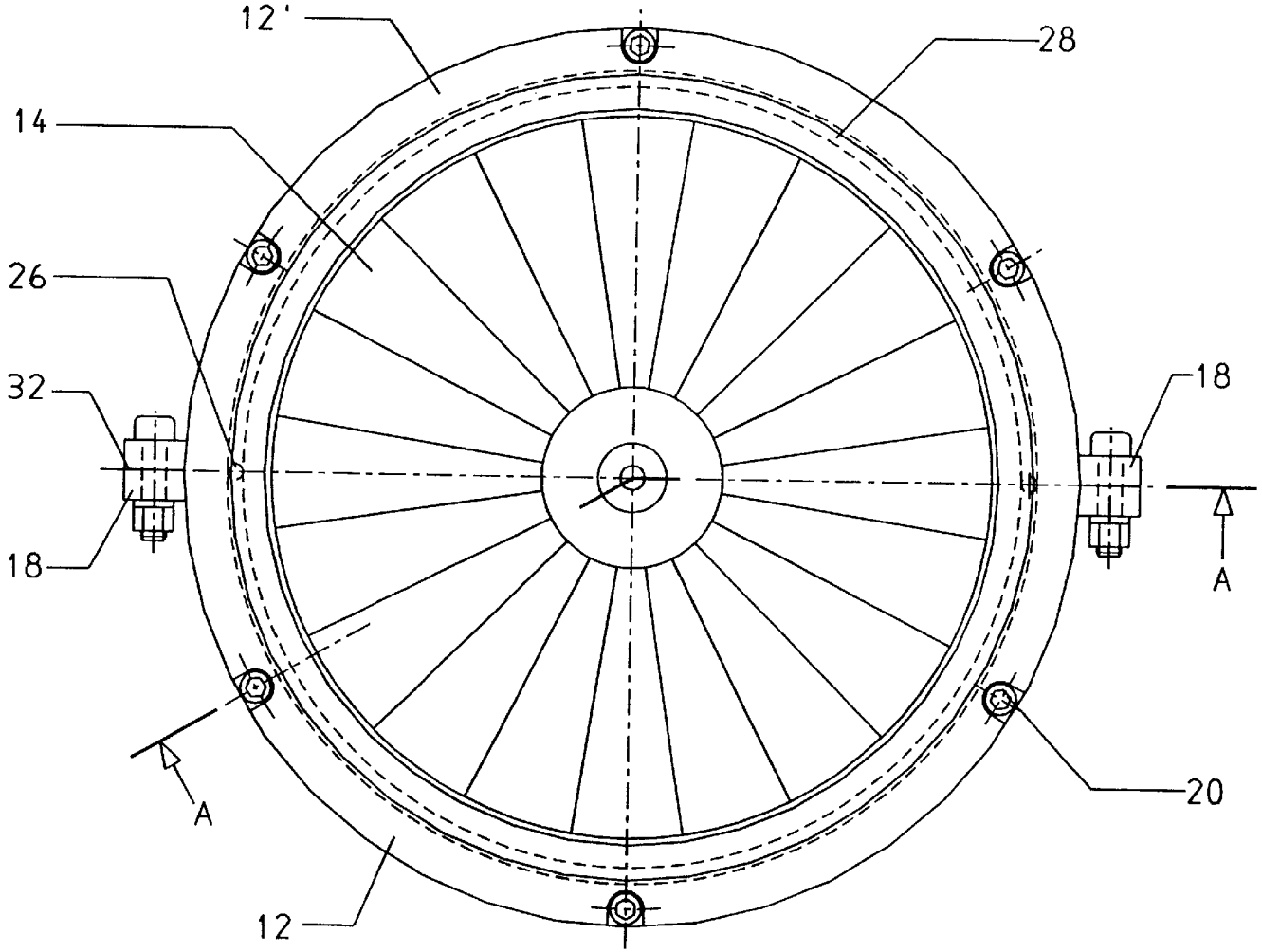
FIG. 2 a plan view of a turbomolecular pump according to the present invention.

A turbomolecular pump according to the present invention, which is shown in FIGS. 1–2, has a section opening 1 and a gas outlet opening 2. The rotor shaft 4 is supported in opposite bearings 8 and 9 and is driven by a motor 6. A plurality of rotor discs 10 is supported on the rotor shaft 4. Two shell-shaped housing parts form, together with respective halves of stator discs 14, two one-piece units 12 and $\mathbf{12}^1$. The units 12 and $\mathbf{12}^1$ are connected with each other with tangential connection elements 18. Between the connection elements 18, seals 26, which extend in the axial direction, are provided. In accordance with a further development of the present invention, the units 12 and $\mathbf{12}^1$ can be vacuum-tightly glued or welded with each other. In the axial direction of the units 12 and $\mathbf{12}^1$, a suction flange 22 is screwed to the units 12 and $\mathbf{12}^1$ at their high-vacuum side, and a bottom 24 is screwed thereto at their vacuum side. Seals 28 and 30 are provided, respectively, between the suction flange 22 and the units 12 and 12[1] and between the bottom 24 and the units 12, 12[1]. The seals 28, 30 can be formed, together with the axial seals 26, as a one-piece sealing element.

The invention is shown and described with reference to a two-part embodiment. Within the scope of the invention, three-or multiple part embodiment can be formed, e.g., when this is necessitated by the manufacturing technology.

Accordingly, though the present invention was shown and described with references to the preferred embodiment, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments with the spirit and scope of the present invention as defined by the appended claims.

What is claimed is:

1. A turbomolecular pump, comprising a cylindrical housing, and rotor and stator discs arranged in the housing and cooperating with each other to produce a pumping effect, wherein the cylindrical housing is formed of at least two housing parts separated along a cylinder axis and each formed, together with respective separated sections of the stator discs, as a one-piece unit, and wherein the two housing parts are vacuum-tightly glued to each other.

2. A turbomolecular pump, comprising a cylindrical housing; and rotor and stator discs arranged in the housing and cooperating with each other to produce a pumping effect, wherein the cylindrical housing is formed of at least two housing parts separated along a cylinder axis and each formed, together with respective separated sections of the stator discs, as a one-piece unit, and wherein the two housing parts are welded to each other.

3. A turbomolecular pump, comprising a cylindrical housing; and rotor and stator discs arranged in the housing and cooperating with each other to produce a pumping effect, wherein the cylindrical housing is formed of at least two housing parts separated along a cylinder axis and each formed, together with respective separated sections of the stator discs, as a one-piece unit, wherein the turbomolecular pump further comprises a suction flange and a bottom screwed to the housing at opposite axial sides of the housing, respectively, wherein the turbomolecular pump further comprises two seals arranged, respectively, between the suction flange and the bottom and respective axial sides of the housing, and wherein axial seals which are arranged between the connection elements, and the two seals are formed as a one-piece sealing element.

* * * * *